US008065965B2

(12) United States Patent
Pearson

(10) Patent No.: US 8,065,965 B2
(45) Date of Patent: Nov. 29, 2011

(54) PORTABLE VIDEO GAME TABLE

(76) Inventor: Gary Pearson, Nashua, NH (US)

( * ) Notice: Subject to any disclaimer, the term of this patent is extended or adjusted under 35 U.S.C. 154(b) by 306 days.

(21) Appl. No.: 12/421,709

(22) Filed: Apr. 10, 2009

(65) Prior Publication Data

US 2009/0194007 A1 Aug. 6, 2009

Related U.S. Application Data

(63) Continuation-in-part of application No. 11/383,579, filed on May 16, 2006.

(60) Provisional application No. 60/681,333, filed on May 16, 2005.

(51) Int. Cl.
*A47B 3/00* (2006.01)

(52) U.S. Cl. ..... 108/132

(58) Field of Classification Search ..... 108/126, 108/132, 133; 248/188.5, 188.6, 188.9; 297/54.17
See application file for complete search history.

(56) References Cited

U.S. PATENT DOCUMENTS 2,189,247 A * 2/1940 Johnson ..... 108/43
2,485,178 A * 10/1949 Weinkauf ..... 108/132
3,917,275 A * 11/1975 Alpher ..... 273/237
4,345,758 A * 8/1982 Kempf ..... 473/475
4,404,915 A * 9/1983 Simpson ..... 108/43
4,422,640 A * 12/1983 Tamarkin ..... 463/47
4,595,086 A * 6/1986 Simpson ..... 190/11
4,909,159 A * 3/1990 Gonsoulin ..... 108/44
4,927,109 A * 5/1990 Wilson ..... 248/354.3
4,986,395 A * 1/1991 Lewis ..... 190/1
5,275,364 A * 1/1994 Burger et al. ..... 248/125.1
5,711,572 A * 1/1998 Khan ..... 297/140
6,033,014 A * 3/2000 Nightengale ..... 297/174 R
6,390,424 B1 * 5/2002 Kidushim et al. ..... 248/122.1
6,675,721 B2 * 1/2004 Zeiders ..... 108/43
6,969,112 B1 * 11/2005 Sherrill ..... 297/16.1
2002/0084728 A1 * 7/2002 Elm et al. ..... 312/222
2005/0279750 A1 * 12/2005 Barquist et al. ..... 220/629
2007/0039524 A1 * 2/2007 Pearson ..... 108/116
2007/0137534 A1 * 6/2007 Dhanoa et al. ..... 108/115

* cited by examiner

*Primary Examiner* — Jose V Chen
*Assistant Examiner* — Matthew Ing
(74) *Attorney, Agent, or Firm* — Michael A. Blake

(57) ABSTRACT

A portable video game table comprising: a table surface with an underside; at least one spring-loaded floor leg rotatably attached to the underside; at least one spring-loaded sofa leg rotatably attached to the underside; a floor leg locking mechanism located on the at least one spring-loaded floor leg; a sofa leg locking mechanism located on the at least one spring-loaded sofa leg; where the table is configured such that the portable video game table can change to and from a folded configuration and a ready-for-use extended configuration.

8 Claims, 12 Drawing Sheets

PORTABLE VIDEO GAME TABLE

CROSS-REFERENCES

This application is a continuation-in-part application of U.S. Ser. No. 11/383,579, filed May 16, 2006, to Gary Pearson, entitled "Portable Video Game Table", the contents of which are fully incorporated by reference herein. The parent application, U.S. Ser. No. 11/383,579, claims the benefit of provisional patent application Ser. No. 60/681,333 by Gary Pearson, entitled "Portable Video Game Table", filed on May 16, 2005, the entire contents of which are fully incorporated by reference herein.

TECHNICAL FIELD

This invention relates to portable tables in general and more particularly to an adjustable portable video game table.

BACKGROUND

Today video and computer games are commonly played by many children and adults. In many game systems a conventional television receiver displays an image generated by the computerized game system. Various types of manual controllers including joy sticks, arcade sticks, and steering wheels may be connected to the game system and used to control the video game. Many households do not have a permanent game table or other suitable table in the room with their television receiver or video monitor, therefore the option of placing the game controller on a table is not available. For aesthetic reasons many households do not want to have a permanent game table in the room with their television receiver or video monitor.

Without a table on which to rest the controller, players frequently position the controller on the floor or in the player's lap, which can make it difficult to play the video game. The problem is exaggerated when the controller is a steering wheel type such as those typically used in race car type video games. Holding the steering wheel controller in the lap may be uncomfortable and may be unstable. Positioning the steering wheel on the floor may also be uncomfortable because it requires the player to bend over the wheel in an uncomfortable position while playing the video game.

Thus there is a need for a portable table capable of being used with an existing seating device and/or on the floor.

SUMMARY

The disclosed invention relates to a portable video game table comprising: a table surface with an underside; at least one spring-loaded floor leg rotatably attached to the underside; at least one spring-loaded sofa leg rotatably attached to the underside; a floor leg locking mechanism located on the at least one spring-loaded floor leg; a sofa leg locking mechanism located on the at least one spring-loaded sofa leg; where the table is configured such that the portable video game table can change to and from a folded configuration and a ready-for-use extended configuration.

The disclosed invention also relates to a portable video game table comprising: a table surface with an underside; a first floor leg sleeve attached to the underside; a first pivot rod in rotatable communication with the first floor leg sleeve; a first upper floor leg top in communication with the first pivot rod; a first upper floor leg in communication with the first upper floor leg top; a first floor leg collar in communication with the first upper floor leg; a first lower floor leg in telescoping communication with the first upper floor leg, and in communication with the first floor leg collar; a first floor leg clip attached to the underside and configured to allow the first upper floor leg top to releasably snap into the clip; a first floor leg locking mechanism housing attached to the first floor leg collar; a first floor leg rack located on the first lower floor leg; a first floor leg pinion in rotatable communication with the first floor leg locking mechanism housing, and configured to releasably mate with the first floor leg rack; a first tension cable in operable communication with the first floor leg pinion, and a first lever located on the underside; a first sofa leg sleeve attached to the underside; a first pivot rod in rotatable communication with the first sofa leg sleeve; a first upper sofa leg top in communication with the first pivot rod; a first upper sofa leg in communication with the first upper sofa leg top; a first sofa leg collar in communication with the first upper sofa leg; a first lower sofa leg in telescoping communication with the first upper sofa leg, and in communication with the first sofa leg collar; a first sofa leg clip attached to the underside and configured to allow the first upper sofa leg top to releasably snap into the clip; a first floor leg locking mechanism housing attached to the first sofa leg collar; a first sofa leg rack located on the first lower sofa leg; a first sofa leg pinion in rotatable communication with the first sofa leg locking mechanism housing, and configured to releasably mate with the first sofa leg rack; a first sofa leg lever attached to the first sofa leg collar, and in operable communication with the first sofa leg pinion; a first sofa leg retainer in operable communication with the first lever; a first sofa leg retainer lip located on the first sofa leg retainer; wherein the first sofa leg retainer is configured to releasably hold the first sofa leg in a folded position against the underside; a first floor leg retainer in operable communication with the first lever; a first floor leg retainer lip located on the first floor leg retainer; wherein the first floor leg retainer is configured to releasably hold the first floor leg in a folded position against the underside; a first sofa leg clip fixed to the underside, and configured to allow the first sofa leg top to releasably snap into the first sofa leg clip; a first floor leg clip fixed to the underside, and configured to allow the first floor leg top to releasably snap into the first floor clip; a second floor leg sleeve attached to the underside; a second pivot rod in rotatable communication with the second floor leg sleeve; a second upper floor leg top in communication with the second pivot rod; a second upper floor leg in communication with the second upper floor leg top; a second floor leg collar in communication with the second upper floor leg; a second lower floor leg in telescoping communication with the second upper floor leg, and in communication with the second floor leg collar; a second floor leg clip attached to the underside and configured to allow the second upper floor leg top to releasably snap into the clip; a second floor leg locking mechanism housing attached to the second floor leg collar; a second floor leg rack located on the second lower floor leg; a second floor leg pinion in rotatable communication with the second floor leg locking mechanism housing, and configured to releasably mate with the second floor leg rack; a second tension cable in operable communication with the second floor leg pinion, and a second lever located on the underside; a second sofa leg sleeve attached to the underside; a second pivot rod in rotatable communication with the second sofa leg sleeve; a second upper sofa leg top in communication with the second pivot rod; a second upper sofa leg in communication with the second upper sofa leg top; a second sofa leg collar in communication with the second upper sofa leg; a second lower sofa leg in telescoping communication with the second upper sofa leg, and in communication with the second sofa leg collar; a second sofa leg clip attached to the underside and configured to allow the second upper sofa leg top to releasably snap into the clip; a second floor leg locking mechanism housing attached to the second sofa leg collar; a second sofa leg rack located on the second lower sofa leg; a second sofa leg pinion in rotatable communication with the second sofa leg locking mechanism housing, and configured to releasably mate with the second sofa leg rack; a second sofa leg lever attached to the second sofa leg collar, and in operable communication with the second sofa leg pinion; a second sofa leg retainer in operable communication with the second lever; a second sofa leg retainer lip located on the second sofa leg retainer; wherein the second sofa leg retainer is configured to releasably hold the second sofa leg in a folded position against the underside; a second floor leg retainer in operable communication with the second lever; a second floor leg retainer lip located on the second floor leg retainer; wherein the second floor leg retainer is configured to releasably hold the second floor leg in a folded position against the underside; a second sofa leg clip fixed to the underside, and configured to allow the second sofa leg top to releasably snap into the second sofa leg clip; and a second floor leg clip fixed to the underside, and configured to allow the floor leg top to releasably snap into the second floor clip.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
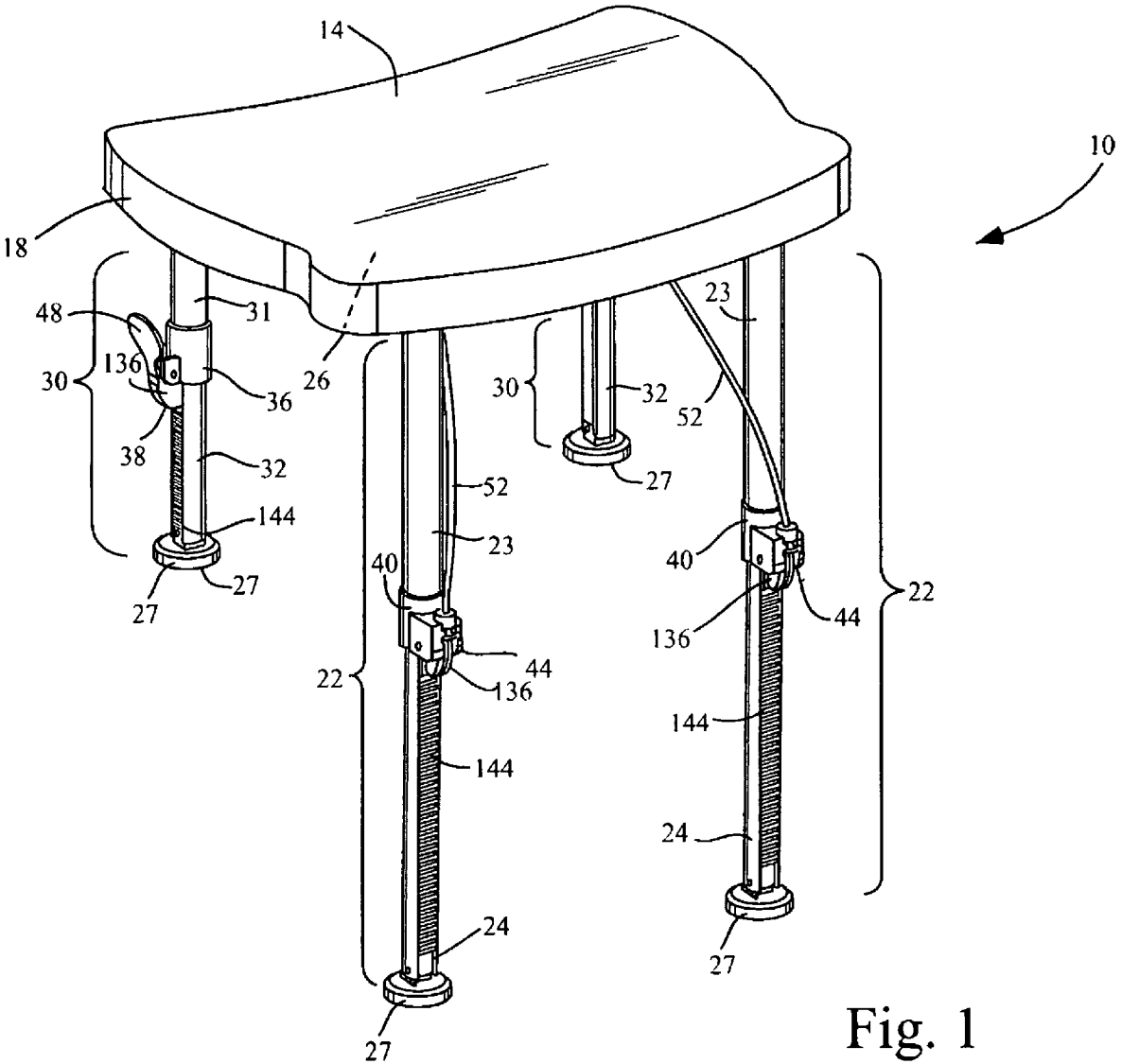
FIG. 1 is a front top perspective view of the disclosed portable video game table.

FIG. 1 shows a perspective view of one embodiment of the disclosed portable video game table 10. The disclosed portable video game table can be used with video games, portable games (e.g. Gameboy), computer games, laptop computers, and other electronic devices. A table surface 14 has a table lip 18. Two spring-loaded floor legs 22 are coupled to the underside 26 of the table surface 14. Two spring-loaded sofa legs 30 are also attached to the underside 26. In this view, the legs 22, 30 are shown in an ready-for-use extended configuration. Each of the legs has feet 27. Each of the spring-loaded floor legs 22 comprises an upper floor leg 23, and a lower floor leg 24. Similarly, each of the spring-loaded sofa legs 30 comprises an upper sofa leg 31, and a lower sofa leg 32. In this embodiment, the feet 27 may have a non-skid surface. A sofa leg collar 36 is in communication with each of the upper sofa legs 31. Attached to each sofa leg collar 36 is a sofa leg locking mechanism 38. Similarly, there is a floor leg collar 40 attached to the upper floor leg 31. A floor leg locking mechanism 44 is attached to each of the collars 40 and is in communication with the upper leg. A sofa leg lever 48 is attached to each of the locking mechanisms 38. A locking cable sleeve 52 is attached to each of the locking mechanisms 44. A locking cable 53 is in slideable communication with the interior of each of the locking cable sleeves 52.

Figure 2:
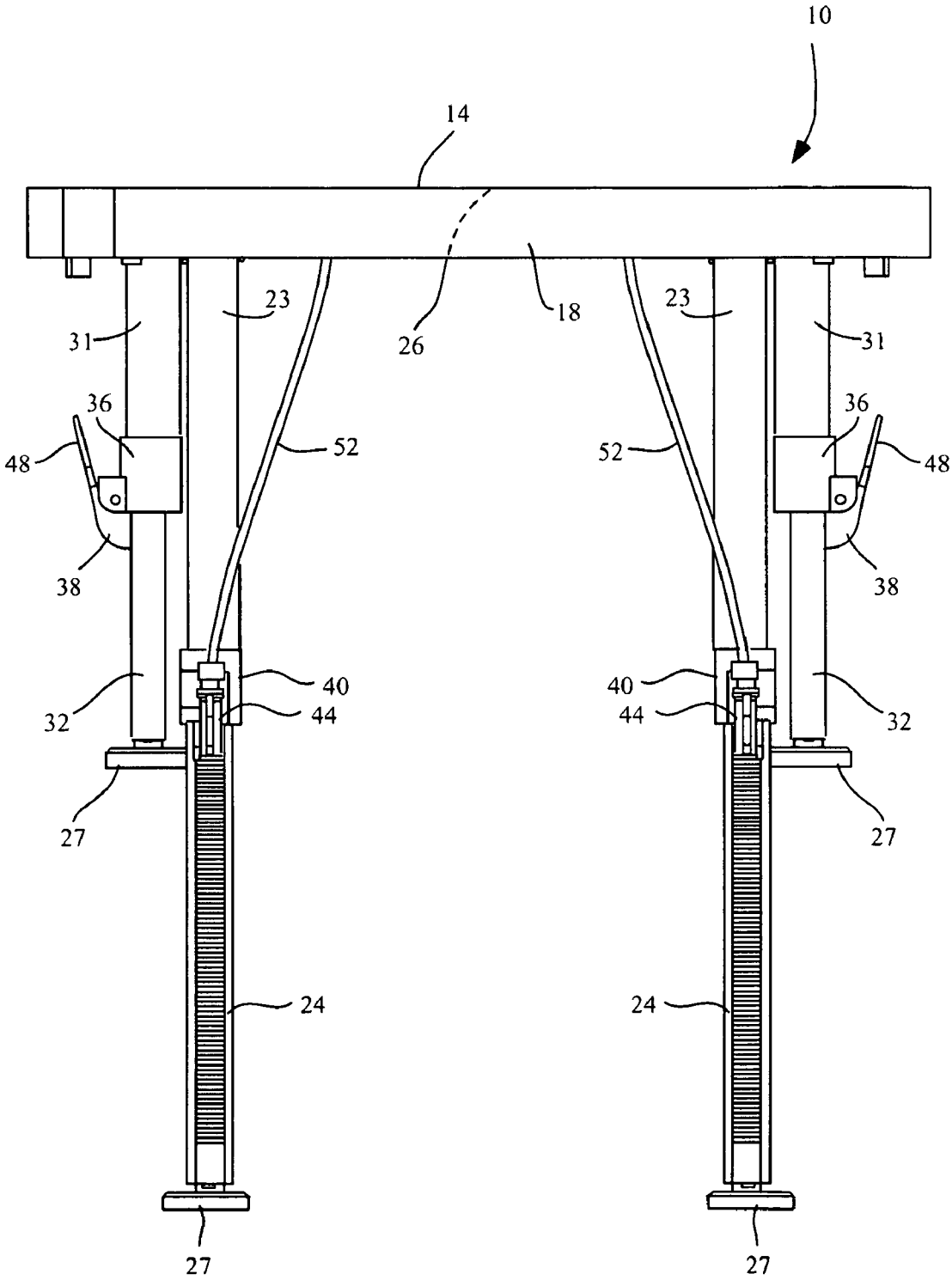
FIG. 2 is a front view of the portable video game table.
Figure 3:
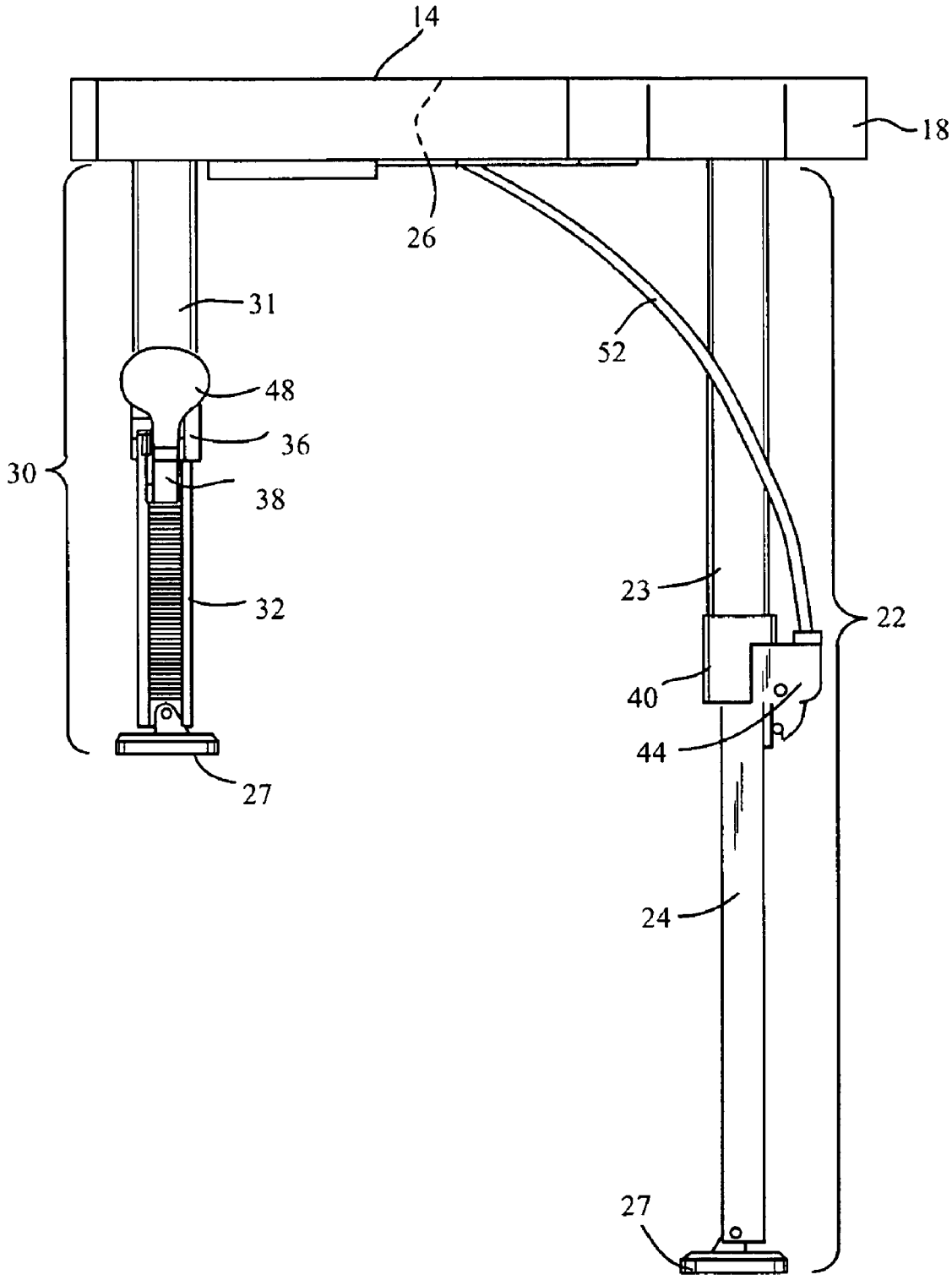
FIG. 3 is side view of the portable video game table.

FIG. 2 is a front view of the disclosed portable video game table 10. FIG. 3 is a side view of the disclosed portable video game table 10.

Figure 4:
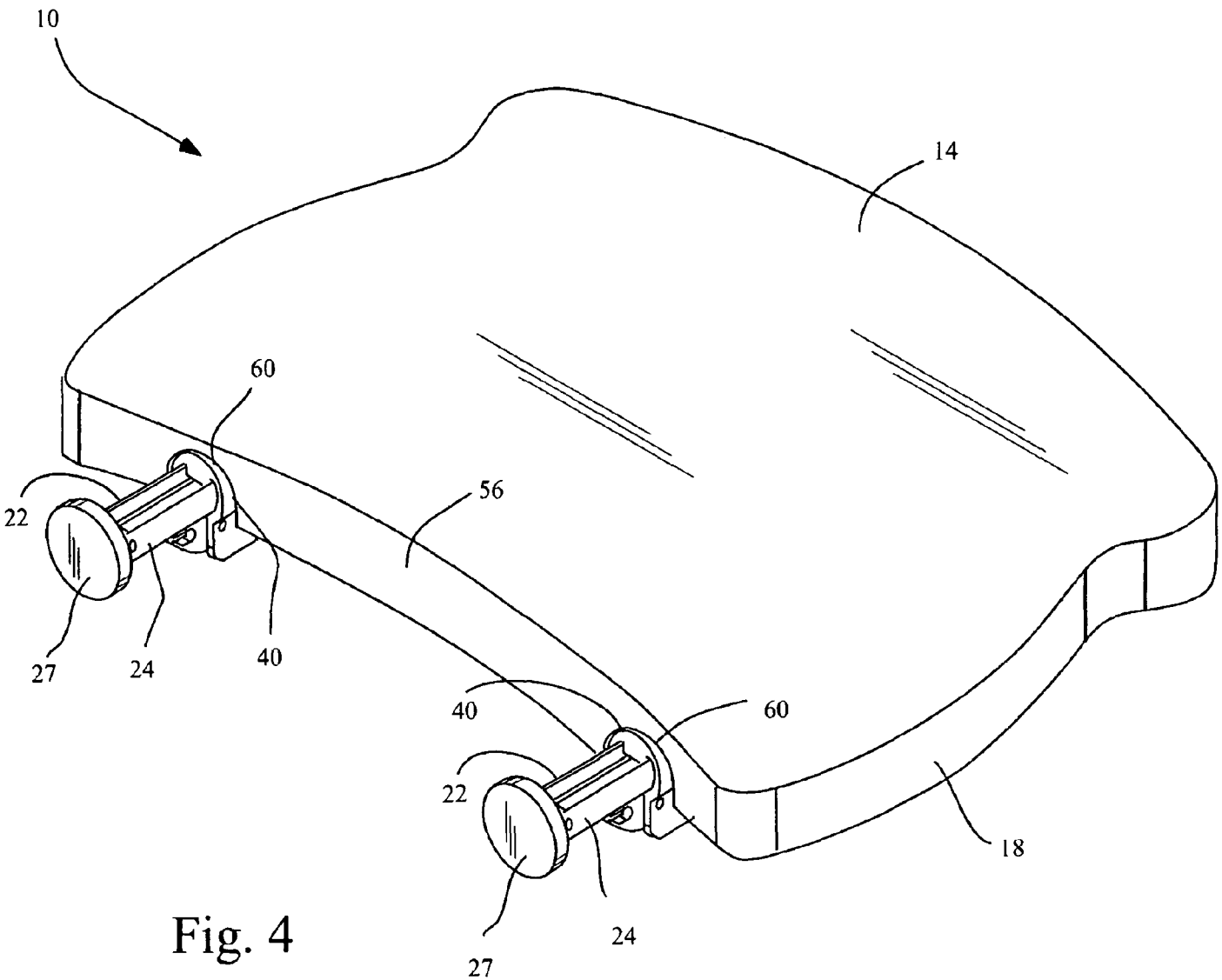
FIG. 4 is a top front perspective view of the portable video game table in a folded configuration.

FIG. 4 shows a perspective view of the disclosed portable video game table 10 with the legs 22, 30 in a folded configuration. Located on the rear lip 56 of the table 10, are two apertures 60, each of which allows the floor leg 22 to extend through the rear lip 56 when in a folded configuration. A portion of each of the collars 40 can be seen exiting the apertures 60. FIG. 4 shows the disclosed portable video game table 10 in a folded configuration. In this folded configuration, the disclosed portable video game table 10 can be easily transported, and stored.

Figure 5:
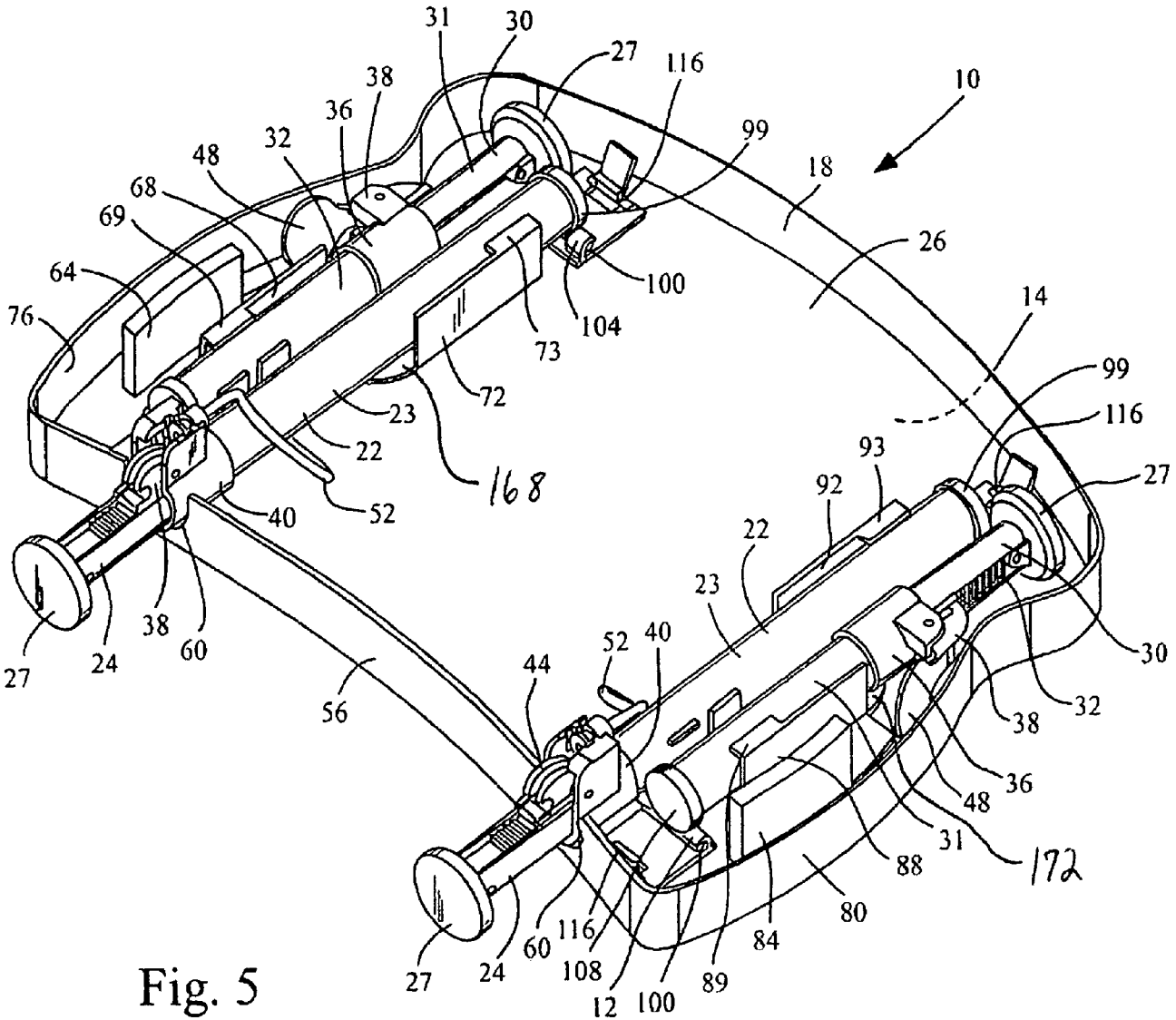
FIG. 5 is a bottom rear perspective view of the disclosed portable video game table.

FIG. 5 shows a perspective view of the underside 26 of the disclosed portable video game table 10. A first lever 64 is shown in operable communication with the underside 26 of the table. The first lever 64 is in operable communication with a first rotatable plate 168, most clearly seen in FIG. 8. The first rotatable plate 168 is rotatably attached to the underside 26 of the table surface 14. Extending generally perpendicularly from the first rotatable plate (in a direction away from the table surface 14) is a first sofa leg retainer 68 and a first floor leg retainer 72. The first sofa leg retainer 68 holds a sofa leg 30 in place, and adjacent to the underside 26 of the table 10. The first sofa leg retainer 68 has a first sofa leg retainer lip 69, which allows the first sofa leg retainer 68 to hold a sofa leg 30 in place, and adjacent to the underside 26 of the table 10. The first floor leg retainer 72 has a first floor leg retainer lip 73, which allows the first floor leg retainer 72 to hold a floor leg 22 in place, and adjacent to the underside 26 of the table 10. In order to release the legs 22, 30, a user moves the first lever 64 towards the right table lip 76, this causes the first rotatable plate 168 to rotate, which causes the first sofa leg retainer 68 to move towards the right table lip 76 and free the sofa leg held in place by the first sofa leg retainer 68; this also causes the first floor leg retainer 72 to move towards the left table lip 80 and free the floor leg which was held in place by the first floor leg retainer 72. Similarly, there is a second lever 84 in operable communication with the underside 26 of the table. The second lever 84 is in operable communication with a second rotatable plate 172, most clearly seen in FIG. 8. The second rotatable plate 172 is rotatably attached to the underside 26 of the table surface 14. Extending generally perpendicularly from the first rotatable plate (in a direction away from the table surface 14) is a second sofa leg retainer 88 and a second floor leg retainer 92. The second sofa leg retainer 88 holds a sofa leg 30 in place, and adjacent to the underside 26 of the table 10. The second sofa leg retainer 88 has a second sofa leg retainer lip 89, which allows the first sofa leg retainer 88 to hold a sofa leg 30 in place, and adjacent to the underside 26 of the table 10. The second floor leg retainer 92 has a second floor leg retainer lip 93, which allows the second floor leg retainer 92 to hold a floor leg 22 in place, and adjacent to the underside 26 of the table 10. In order to release the legs 22, 30 held in place by the second sofa leg retainer 88, and second floor leg retainer 92, a user moves the second lever 84 towards the left table lip 80, this causes the second rotatable plate 172 to rotate, which causes the second sofa leg retainer 88 to move towards the left table lip 80 and free the sofa leg 30; this also causes the second floor leg retainer 92 to move towards the right table lip 76 and free the floor leg 22. One of ordinary skill in the art will recognized that the disclosed invention may be modified such that the first lever 64 and second lever 84 may be moved in other directions, pushed, pulled, pressed, or lifted in order to release the retainers 72, 88, and/or release the locking mechanisms 44.

Also shown in FIG. 5, are the pivot mechanisms for the legs 22, 30. A relatively unobstructed view of a pivot mechanism for a floor leg 22 is shown on the floor leg 22 nearest to the right lip 76. The floor leg 22 nearest the left lip 80 has a similar pivot mechanism. The top 99 of the upper leg 23 of the floor leg is attached to a pivot rod 100. The pivot rod 100 is in rotative communication with at least one floor leg sleeve 104. Floor leg sleeve 104 is fixedly attached to the underside 26 of the disclosed portable video game table 10. A relatively unobstructed view of a pivot mechanism for a sofa leg 30 is shown with respect to the sofa leg 30 nearest the left lip 80. The top 108 of upper sofa leg 31 is attached to a pivot rod 100. The pivot rod 100 is in rotative communication with at least one sofa leg sleeve 112. The at least one sleeve 112 is in fixed communication with the underside 26 of the disclosed portable video game table 10. A similar pivot mechanism is in communication with sofa leg 30 nearest the right lip 76.

The disclosed portable video game table may also have clips 116 positioned on the underside 26 to hold the legs 22, 30 in place when the legs are pivoted out of the retainers 88, 92. The clips 116 may be configured to snap or otherwise attach to the tops 99 of upper floor legs 23, and to the tops 108 of the upper sofa leg 31.

Figure 6:
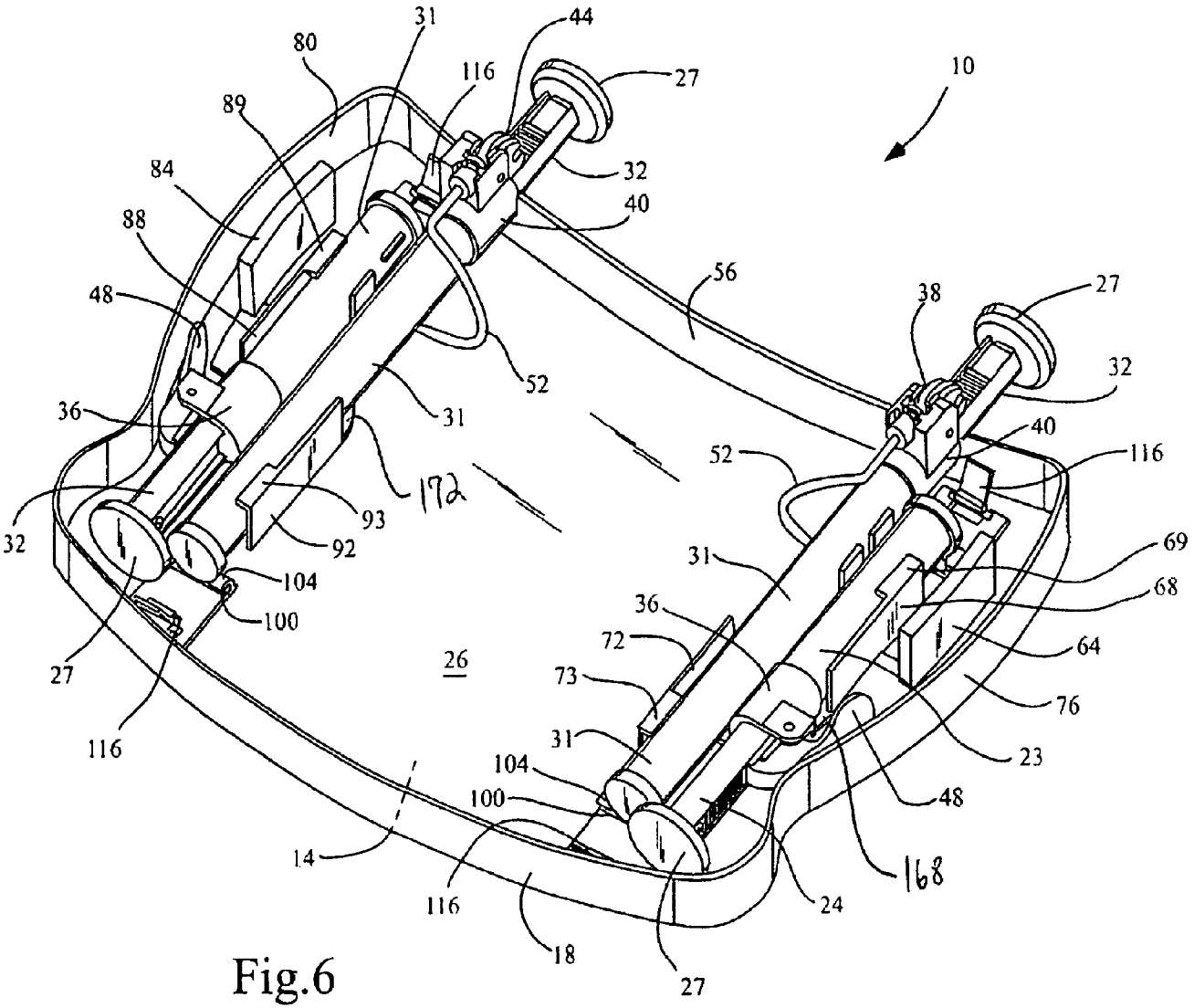
FIG. 6 is a bottom front perspective view of the portable video game table.

FIG. 6 shows another perspective view of the underside 26 of the disclosed portable video game table 10, but this view is from the front of the table.

Figure 7:
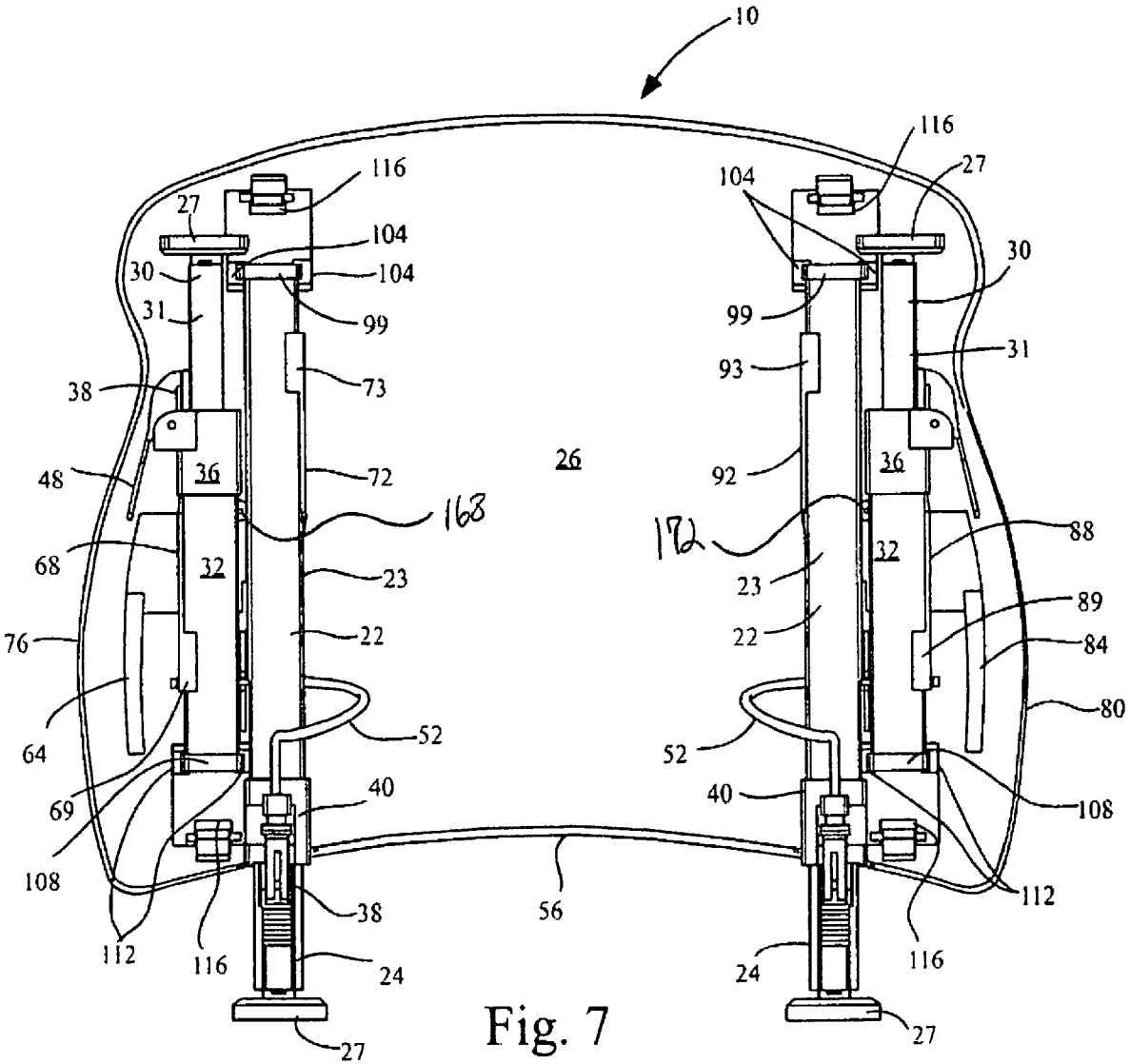
FIG. 7 is a bottom view of the portable video game table.

FIG. 7 shows a top view of the underside 26 of the disclosed portable video game table 10.

Figure 8:
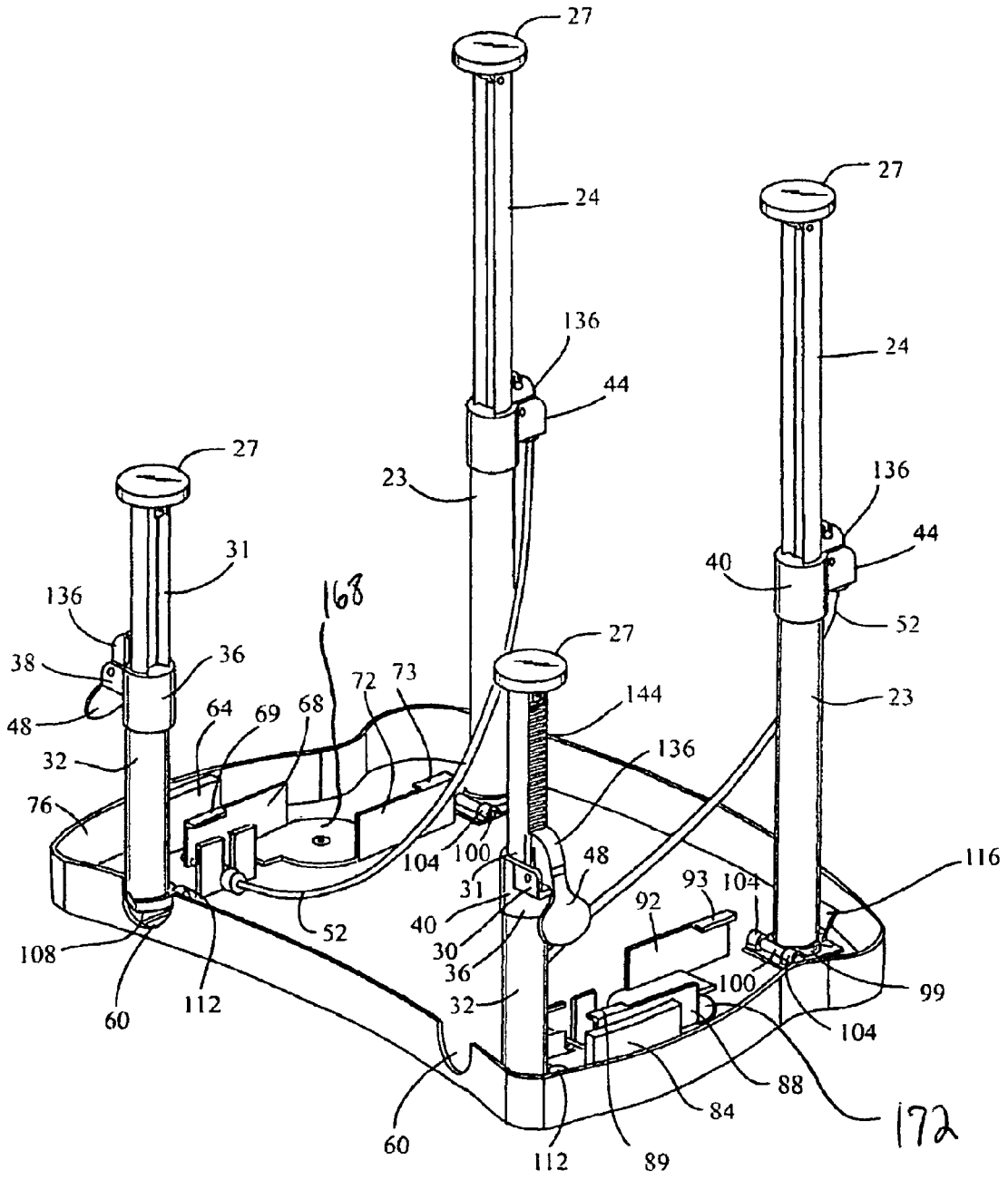
FIG. 8 is a bottom rear perspective view of the portable video game table with the legs unfolded and extended.

FIG. 8 shows a rear perspective view of the underside 26 of the disclosed portable video game table 10. In this view, the legs 22, 30 are shown pivoted out of the retainers 88, 92. Additionally, the lower floor legs 24, and lower sofa legs 32 are shown extended out of the upper floor legs 23 and upper sofa legs 31 respectively. One of ordinary skill in the art will recognize that the legs 22, 30 are telescoping legs. In this view, one can see that one of the two locking cables 53 is in operational communication with the first lever 64 (similarly, second lever 84 is operational communication with the other locking cable 53) via the first sofa leg retainer 68. When the first lever 64 is moved towards the right lip 76, the locking cable 53 will develop a tension that is transferred to the locking mechanism 38.

Figure 9:
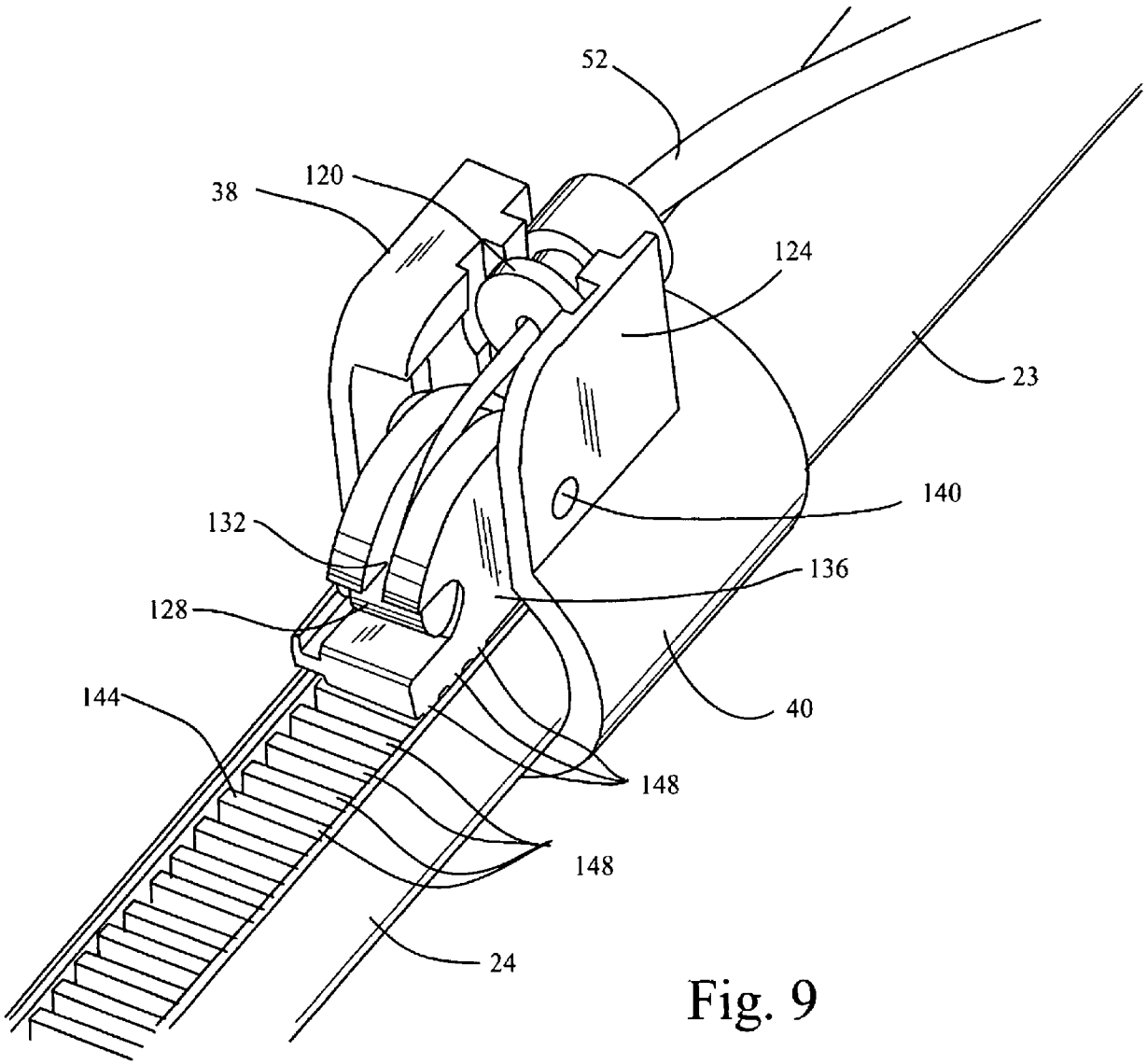
FIG. 9 is a close-up perspective view of the floor leg locking mechanism.
Figure 10:
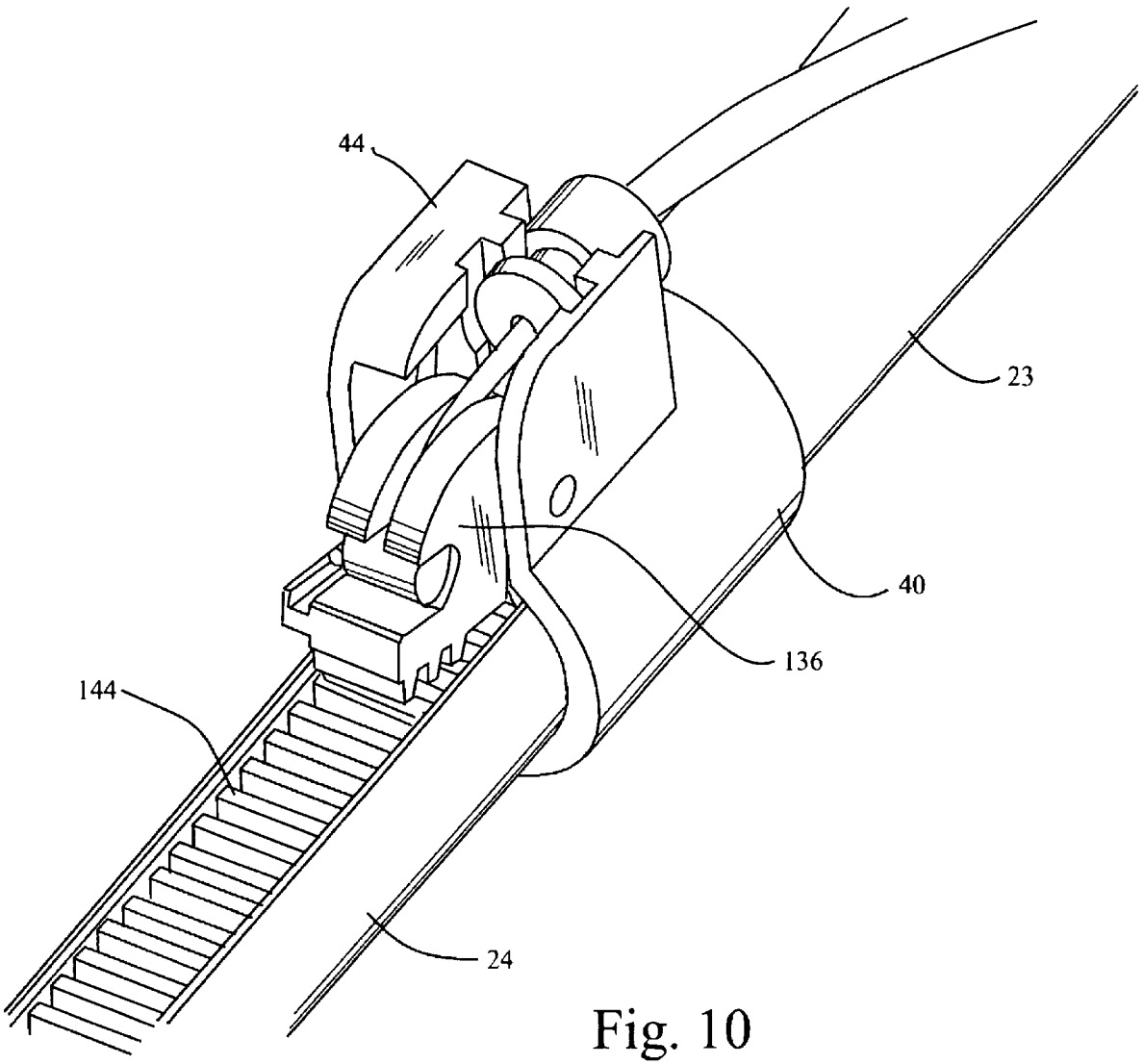
FIG. 10 is a close-up perspective view of the floor leg locking mechanism in an un-mated position.

FIG. 9 shows a close-up perspective view of the locking mechanism 38 (which is similar to the locking mechanism 44). The locking cable sleeve 52 is held in place by a cable sleeve collar 120 that is coupled to the locking mechanism housing 124. The cable 53 has an anchor 128 located on a first end 132 of the cable 53. The anchor 128 is attached to a pinion 136. The pinion 136 has a plurality of teeth 148. The pinion is rotatable about a pivot point 140 located on the locking mechanism housing 124. In this Figure, the pinion 136 is shown mated to the rack 144 located on the lower floor leg 24. The rack 144 has a plurality of teeth 148 configured to mate with the pinion 136. When the pinion 136 is mated to the rack 144 as shown in FIG. 9, the lower floor leg 24 is locked relative to the upper floor leg 23. When the first lever 64 is moved towards the right lip 76, tension is exerted on the cable 53. The tension causes the anchor 128 to make the pinion 136 pivot about the pivot point 140, thereby causing the pinion 136 to become disengaged from the rack 144. Once the pinion 136 is disengaged from the rack 144, the user can adjust the telescoping lower floor leg 24 with respect to the upper floor leg 23. Once a suitable length of the leg 22 is reached, the user can release the first lever 64, whereby the pinion 136 reengages with the rack 144, and locks the lower floor leg 24 with respect to the upper floor leg 23. FIG. 10 shows the pinion 136 disengaged from the rack 144. This rack and pinion locking system may be used on both the sofa legs 30 and the floor legs 22. Of course, other means for extending and locking the legs in place may be used. On each of the sofa legs, instead of using a cable 53, each sofa leg lever 48 is attached to a pinion 136 such that when the lever 48 is rotated about its pivot point, the pinion 136 rotates about its pivot point so that it the pinion 136 disengages from a rack located on the lower sofa legs 32. One of ordinary skill in the art will recognized that the cable 53 and cable sleeve 52 are just one of many actuating means that may be used to engage and disengage the pinion 136 from the rack 144.

Figure 11:
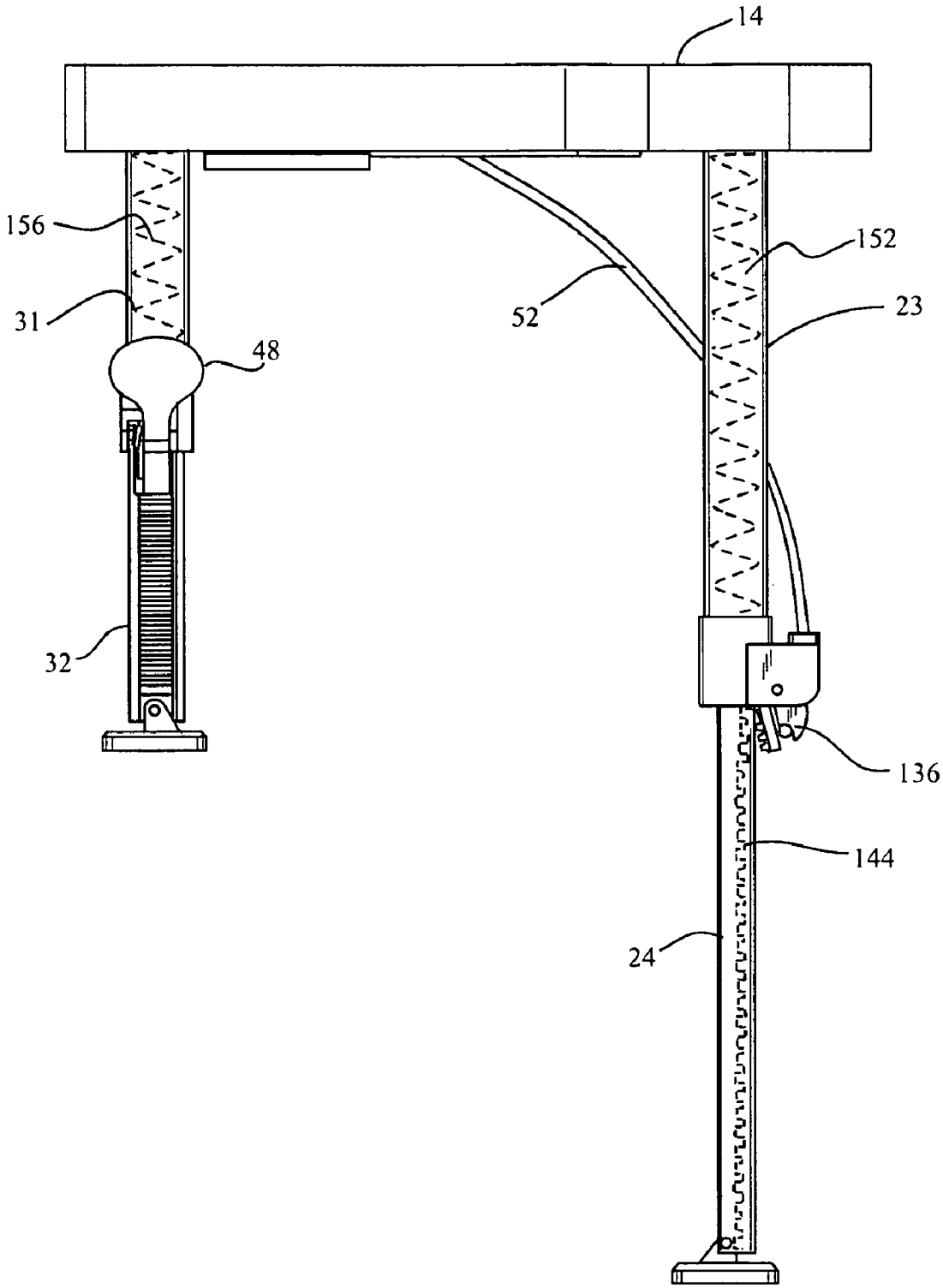
FIG. 11 is a side view of the portable video game table with the interior components visible.

FIG. 11 shows a side view of the disclosed portable video game table 10 with the internal components visible. A compression spring 152 is shown inside the upper floor leg 23. A compression spring 156 is shown inside the upper sofa leg 31. The compression spring 152, 156 are configured so that when the pinions 136 are disengaged from the racks 144, the lower sofa leg 32 will automatically telescope out with respect to upper sofa legs 31. Therefore, if one is seated on a seating surface, such as a sofa for example, holding the folded up table 10 in front of him or her, the legs 22, 30 will extend until the spring-loaded floor legs 22 impinge the floor or other surface.

To operate the disclosed portable video game table 10, one would hold the table 10 in an upright position, and pull move the first and second levers 64, 84 towards the right lip 76 and left lip 80 respectively to allow the legs 22, 30 to disengage from the retainers 68, 72 and swing away from the underside 26 of the table 10. At this point, the first and second levers 64, 84 may be moved further towards the right lip 76 and the left lip 80 respectively, allowing the pinions 136 on the floor legs to disengaged from the racks 144 located on the lower floor legs 24, thereby allowing the lower floor legs 24 to move freely relative to the upper floor legs 23. Once the proper length of the floor legs is achieved, the first and second levers 64, 84 maybe released, thereby locking the floor legs 22 in place. Now the sofa leg levers 48 may be rotated, to release the pinions 136 on the sofa legs 30 from the racks 144 located on the lower sofa legs 30. Once the proper length of the sofa legs 30 are achieved, the levers 48 may be moved back to their locked position, thereby causing the pinions 136 to engage the racks 144 on the lower sofa legs 32, and lock the lower sofa legs 32 in place relative to the upper sofa legs 31. The legs, 22, 30, will swing freely, still attached to the undersigned by brackets 46, which allow the legs to rotate freely. The legs 22,30 may be spring loaded with a torsion spring to rotate the legs into a fixed position approximately 95 degrees from horizontal, and held in place either by the spring force, or a detent design, or both.) The feet 27 may have a non-skid surface. The feet 27 may be able to pivot with respect to the lower legs 24, 32 via a pivot attachment, or a universal joint.

Figure 12:
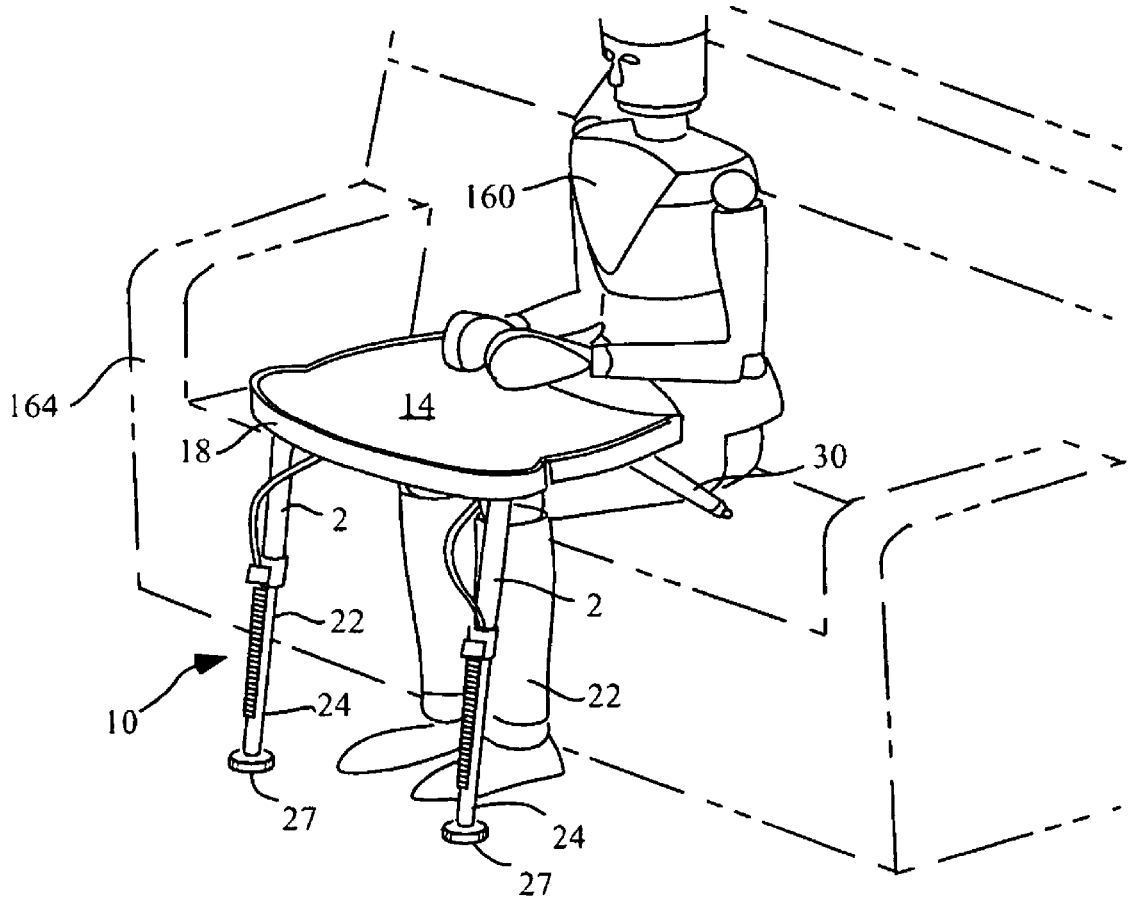
FIG. 12 is a perspective view of the portable video game table in one of its many uses.

FIG. 12 shows the disclosed table 10 being used by a user 160. The spring-loaded floor legs 22 are extended to the floor. The spring-loaded sofa legs 30 are extended to the sofa 164, adjacent to the user 160.

The disclosed portable video game table 10 is advantageous in that it may be used while sitting on the ground, in a chair, or on a stool. Additionally, it is portable, in that it can fold to a very small shape, with the legs folded in and against the underside 26 of the table surface 14. The table 10 is easily adjustable due to the levers and the rack and pinion locking system.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A portable video game table comprising:

a table surface with an underside;

a first spring-loaded floor leg rotateably attached to the underside, the first spring-loaded floor leg comprising:

an upper floor leg;

a floor leg collar in communication with the upper floor leg;

a lower floor leg in communication with the floor leg collar, and in telescoping communication with the upper floor leg;

a first compression spring located inside of the upper floor leg, and exerting a force on the lower floor leg that tends to telescope the lower floor leg out from the upper floor leg;

a first spring-loaded sofa leg rotateably attached to the underside, the first spring-loaded sofa leg comprising:

an upper sofa leg;

a sofa leg collar in communication with the upper sofa leg;

a lower sofa leg in communication with the sofa leg collar, and in telescoping communication with the upper sofa leg;

a second compression spring located inside of the upper sofa leg, and exerting a force on the lower sofa leg that tends to telescope the lower sofa leg out from the upper sofa leg;

a floor leg locking mechanism located on the first spring-loaded floor leg;

a sofa leg locking mechanism located on the first spring-loaded sofa leg;

a second spring-loaded floor leg rotateably attached to the underside, the second spring-loaded floor leg comprising:

an upper floor leg;

a floor leg collar in communication with the upper floor leg;

a lower floor leg in communication with the floor leg collar, and in telescoping communication with the upper floor leg;

a second compression spring located inside of the upper floor leg, and exerting a force on the lower floor leg that tends to telescope the lower floor leg out from the upper floor leg;

a second spring-loaded sofa leg rotateably attached to the underside, the second spring-loaded sofa leg comprising:

an upper sofa leg;

a sofa leg collar in communication with the upper sofa leg;

a lower sofa leg in communication with the sofa leg collar, and in telescoping communication with the upper sofa leg;

a second compression spring located inside of the upper sofa leg, and exerting a force on the lower sofa leg that tends to telescope the lower sofa leg out from the upper sofa leg;

a floor leg locking mechanism located on the second spring-loaded floor leg;

a sofa leg locking mechanism located on the second spring-loaded sofa leg;

a first rotatable plate located rotatably attached to the underside;

a first lever in communication with the first rotatable plate;

a first sofa leg retainer in communication with the first lever and the first rotatable plate;

a first sofa leg retainer lip attached to the first sofa leg retainer, wherein the first sofa leg retainer lip releaseably holds the first sofa leg in the sofa leg retainer, adjacent to the underside, and wherein the first lever, the first sofa leg retainer, and the first sofa leg retainer lip can be rotated away from the first sofa leg via the first rotatable plate, thereby releasing the first sofa leg from the first sofa leg retainer lip, and further allowing the sofa leg to swing away from the underside;

a first floor leg retainer in communication with the first lever and the first rotatable plate;

a first floor leg retainer lip attached to the first floor leg retainer, wherein the first floor leg retainer lip releaseably holds the first floor leg in the first floor leg retainer, adjacent to the underside, and wherein the first lever, the first floor leg retainer, and the first floor leg retainer lip can be rotated away from the first floor leg via the first rotatable plate, thereby releasing the first floor leg from the first floor leg retainer lip, and further allowing the floor leg to swing away from the underside;

a second rotatable plate rotatably attached to the underside;

a second lever in communication with the second rotatable plate;

a second sofa leg retainer in communication with the second lever and the second rotatable plate;

a second sofa leg retainer lip attached to the second sofa leg retainer, wherein the second sofa leg retainer lip releaseably holds the second sofa leg in the sofa leg retainer, adjacent to the underside, and wherein the second lever, the second sofa leg retainer, and the second sofa leg retainer lip can be rotated away from the second sofa leg via the second rotatable plate, thereby releasing the second sofa leg from the second sofa leg retainer lip, and further allowing the sofa leg to swing away from the underside;

a second floor leg retainer in communication with the second lever and the second rotatable plate;

a second floor leg retainer lip attached to the second floor leg retainer, wherein the second floor leg retainer lip releaseably holds the second floor leg in the second floor leg retainer, adjacent to the underside, and wherein the second lever, the second floor leg retainer, and the second floor leg retainer lip can be rotated away from the second floor leg via the second rotatable plate, thereby releasing the second floor leg from the second floor leg retainer lip, and further allowing the floor leg to swing away from the underside; and wherein the table is configured such that the portable video game table can change to and from a folded configuration and a ready-for-use extended configuration.

2. The portable video game table of claim 1, where the length of the at least one spring-loaded floor leg is adjustable, and where the length of the one spring-loaded sofa leg is adjustable.

3. The portable video game table of claim 1, wherein the floor leg locking mechanism comprises:

a locking mechanism housing attached to the floor leg collar;

a floor leg rack located on the lower floor leg;

a floor leg pinion in rotatable communication with the locking mechanism housing, and configured to releasably mate with the floor leg rack;

an floor leg actuating means in operable communication with the floor leg pinion, and configured to disengage the floor leg pinion from mating with the floor leg rack when actuated, and further configured to mate the floor leg pinion to the floor leg rack when non-actuated;

wherein the sofa leg locking mechanism comprises:

a locking mechanism housing attached to the sofa leg collar;

a sofa leg rack located on the lower sofa leg;

a sofa leg pinion in rotatable communication with the locking mechanism housing, and configured to releasably mate with the sofa leg rack; and a sofa leg actuating means in operable communication with the sofa leg pinion, and configured to disengage the sofa leg pinion from mating with the sofa leg rack when actuated, and further configured to mate the sofa leg pinion to the sofa leg rack when non-actuated.

4. The portable video game table of claim 3, wherein the floor leg actuating means is a tension cable in operable communication with the floor leg pinion, and the at least one lever located on the underside.

5. The portable video game table of claim 3, wherein the sofa leg actuating means is a sofa leg lever in operable communication with the sofa leg pinion, and sofa leg lever is rotateably attached to the sofa leg collar.

6. The portable video game table of claim 1, wherein each of the legs has a foot with a non-skid surface.

7. The portable video game table of claim 3, wherein the sofa leg pinion has a plurality of teeth configured to mate with a plurality of teeth located on the sofa leg rack, and wherein the floor leg pinion has a plurality of teeth configured to mate with a plurality of teeth located on the floor leg rack.

8. A portable video game table comprising:

a table surface with an underside;

a first floor leg sleeve attached to the underside;

a first pivot rod in rotatable communication with the first floor leg sleeve;

a first upper floor leg top in communication with the first pivot rod;

a first upper floor leg in communication with the first upper floor leg top;

a first floor leg collar in communication with the first upper floor leg;

a first lower floor leg in telescoping communication with the first upper floor leg, and in communication with the first floor leg collar;

a first compression spring located inside of the upper floor leg, and exerting a force on the lower floor leg that tends to telescope the lower floor leg out from the upper floor leg;

a first floor leg clip attached to the underside and configured to allow the first upper floor leg top to releasably snap into the clip;

a first floor leg locking mechanism housing attached to the first floor leg collar;

a first floor leg rack located on the first lower floor leg;

a first floor leg pinion in rotatable communication with the first floor leg locking mechanism housing, and configured to releasably mate with the first floor leg rack;

a first rotatable plate rotatably attached to the underside;

a first tension cable in operable communication with the first floor leg pinion, and a first lever located on the underside;

a first sofa leg sleeve attached to the underside;

a first pivot rod in rotatable communication with the first sofa leg sleeve;

a first upper sofa leg top in communication with the first pivot rod;

a first upper sofa leg in communication with the first upper sofa leg top;

a first sofa leg collar in communication with the first upper sofa leg;

a first lower sofa leg in telescoping communication with the first upper sofa leg, and in communication with the first sofa leg collar;

a second compression spring located inside of the upper sofa leg, and exerting a force on the lower sofa leg that tends to telescope the lower sofa leg out from the upper sofa leg;

a first sofa leg clip attached to the underside and configured to allow the first upper sofa leg top to releasably snap into the clip;

a first floor leg locking mechanism housing attached to the first sofa leg collar;

a first sofa leg rack located on the first lower sofa leg;

a first sofa leg pinion in rotatable communication with the first sofa leg locking mechanism housing, and configured to releasably mate with the first sofa leg rack;

a first sofa leg lever attached to the first sofa leg collar, and in operable communication with the first sofa leg pinion;

a first sofa leg retainer in operable communication with the first lever and the first rotatable plate;

a first sofa leg retainer lip located on the first sofa leg retainer;

wherein the first sofa leg retainer is configured to releasably hold the first sofa leg in a folded position against the underside, and wherein the first lever, the first sofa leg retainer, and the first sofa leg retainer lip can be rotated away from the first sofa leg via the first rotatable plate, thereby releasing the first sofa leg from the first sofa leg retainer lip;

a first floor leg retainer in operable communication with the first lever and the first rotatable plate;

a first floor leg retainer lip located on the first floor leg retainer;

wherein the first floor leg retainer is configured to releasably hold the first floor leg in a folded position against the underside, and wherein the first lever, the first floor leg retainer, and the first floor leg retainer lip can be rotated away from the first floor leg via the first rotatable plate, thereby releasing the first floor leg from the first floor leg retainer lip;

a first sofa leg clip fixed to the underside, and configured to allow the first sofa leg top to releasably snap into the first sofa leg clip;

a first floor leg clip fixed to the underside, and configured to allow the first floor leg top to releasably snap into the first floor clip;

a second floor leg sleeve attached to the underside;

a second pivot rod in rotatable communication with the second floor leg sleeve;

a second upper floor leg top in communication with the second pivot rod;

a second upper floor leg in communication with the second upper floor leg top;

a second floor leg collar in communication with the second upper floor leg;

a second lower floor leg in telescoping communication with the second upper floor leg, and in communication with the second floor leg collar;

a second floor leg clip attached to the underside and configured to allow the second upper floor leg top to releasably snap into the clip;

a second floor leg locking mechanism housing attached to the second floor leg collar;

a second floor leg rack located on the second lower floor leg;

a second floor leg pinion in rotatable communication with the second floor leg locking mechanism housing, and configured to releasably mate with the second floor leg rack;

a second rotatable plate rotatably attached to the underside;

a second tension cable in operable communication with the second floor leg pinion, and a second lever located on the underside;

a second sofa leg sleeve attached to the underside;

a second pivot rod in rotatable communication with the second sofa leg sleeve;

a second upper sofa leg top in communication with the second pivot rod;

a second upper sofa leg in communication with the second upper sofa leg top;

a second sofa leg collar in communication with the second upper sofa leg;

a second lower sofa leg in telescoping communication with the second upper sofa leg, and in communication with the second sofa leg collar;

a second sofa leg clip attached to the underside and configured to allow the second upper sofa leg top to releasably snap into the clip;

a second floor leg locking mechanism housing attached to the second sofa leg collar;

a second sofa leg rack located on the second lower sofa leg;

a second sofa leg pinion in rotatable communication with the second sofa leg locking mechanism housing, and configured to releasably mate with the second sofa leg rack;

a second sofa leg lever attached to the second sofa leg collar, and in operable communication with the second sofa leg pinion;

a second sofa leg retainer in operable communication with the second lever and the second rotatable plate;

a second sofa leg retainer lip located on the second sofa leg retainer;

wherein the second sofa leg retainer is configured to releasably hold the second sofa leg in a folded position against the underside, and wherein the second lever, the second sofa leg retainer, and the second sofa leg retainer lip can be rotated away from the second sofa leg via the second rotatable plate, thereby releasing the second sofa leg from the second sofa leg retainer lip;

a second floor leg retainer in operable communication with the second lever and the second rotatable plate;

a second floor leg retainer lip located on the second floor leg retainer;

wherein the second floor leg retainer is configured to releasably hold the second floor leg in a folded position against the underside, and wherein the second lever, the second floor leg retainer, and the second floor leg retainer lip can be rotated away from the second floor leg via the second rotatable plate, thereby releasing the second floor leg from the second floor leg retainer lip;

a second sofa leg clip fixed to the underside, and configured to allow the second sofa leg top to releasably snap into the second sofa leg clip; and a second floor leg clip fixed to the underside, and configured to allow the floor leg top to releasably snap into the second floor clip.

* * * * *